US007377094B2

(12) United States Patent
Grecksch et al.

(10) Patent No.: US 7,377,094 B2
(45) Date of Patent: May 27, 2008

(54) OPEN END ROTOR SPINNING MACHINE

(75) Inventors: Hans Grecksch, Mönchengladbach (DE); Heinz-Josef Peuker, Wegberg (DE); Michael Mohr, Schwalmtal (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 5 days.

(21) Appl. No.: 11/494,137

(22) Filed: Jul. 27, 2006

(65) Prior Publication Data

US 2007/0028585 A1 Feb. 8, 2007

(30) Foreign Application Priority Data

Aug. 3, 2005 (DE) ..... 10 2005 036 485

(51) Int. Cl.
*D01H 4/50* (2006.01)

(52) U.S. Cl. ..... 57/263

(58) Field of Classification Search ..... 57/22, 57/263

See application file for complete search history.

(56) References Cited

U.S. PATENT DOCUMENTS

| | | | | |
|---|---|---|---|---|
| 4,265,083 | A | 5/1981 | Braun et al. | 57/263 |
| 5,419,111 | A | 5/1995 | Wassenhoven et al. | 57/407 |
| 5,778,651 | A | 7/1998 | Spindler et al. | 57/263 |
| 6,221,121 | B1 | 4/2001 | Schelter et al. | 55/467 |
| 6,412,266 | B2 * | 7/2002 | Paweletz et al. | 57/263 |
| 6,606,847 | B2 | 8/2003 | Ludviček et al. | 57/263 |
| 2003/0038206 | A1 | 2/2003 | Grecksch et al. | 242/475.6 |
| 2005/0044841 | A1 * | 3/2005 | Brandl et al. | 57/263 |

FOREIGN PATENT DOCUMENTS

| | | |
|---|---|---|
| DE | 2203 198 | 8/1973 |
| DE | 25 34 816 | 2/1977 |
| DE | 27 54 785 | 7/1978 |
| DE | 28 11 960 | 9/1979 |
| DE | 43 09 947 A1 | 9/1994 |
| DE | 196 41 060 A1 | 4/1997 |
| DE | 198 27 605 A1 | 12/1999 |
| DE | 198 36 065 A1 | 2/2000 |

(Continued)

OTHER PUBLICATIONS

German Search Report.

*Primary Examiner*—Shaun R. Hurley
(74) *Attorney, Agent, or Firm*—Kennedy Covington Lobdell & Hickman, LLP

(57) ABSTRACT

An open end rotor spinning machine with plural workstations each having a yarn spinning device, a yarn take-off mechanism loaded by a reversibly driven single drive and a winding device for producing a cross-wound bobbin. The spinning device has a spinning rotor, a fiber band opening roller and a single motor-driven fiber band feed cylinder. Each workstation (2) has a mechanism (10) for cutting to length a yarn (30) retrieved from the bobbin (22), a yarn storage mechanism (37) and a drive mechanism (7) for lifting the bobbin (22) from its drive roller (23). During the piecing process, a manually activatable control mechanism (9) activates the drive (19) of the yarn take-off mechanism (18), the drive (15) of the fiber band draw-in cylinder (14) and the drive mechanism (7) to lift the bobbin (22) according to a predetermined piecing program.

9 Claims, 3 Drawing Sheets

FOREIGN PATENT DOCUMENTS

| | | |
|---|---|---|
| DE | 100 62 096 A1 | 7/2001 |
| DE | 101 33 125 | 2/2002 |
| DE | 698 03 275 T2 | 5/2002 |
| EP | 1 283 288 A2 | 2/2003 |
| WO | WO 98/36115 | 8/1998 |

* cited by examiner

OPEN END ROTOR SPINNING MACHINE

CROSS-REFERENCE TO RELATED APPLICATIONS

This application claims the benefit of German patent application 102005036485.3 filed Aug. 3, 2005, herein incorporated by reference.

BACKGROUND OF THE INVENTION

The invention relates to an open end rotor spinning machine with plural workstations each having a spinning device for producing a yarn, a yarn take-off mechanism and a winding device for producing a cross-wound bobbin rotatably held in a creel. More particularly, the spinning device has a spinning rotor circulating in a spinning housing at a high speed, a fiber band opening roller and a fiber band draw-in cylinder driven by a single drive, and the yarn take-off mechanism is loadable by a single drive.

Open end rotor spinning machines of this type, as known and described, for example, in German Patent Publication DE 198 36 065 A1, have a plurality of similar workstations arranged next to one another in a row, on which a fiber band preferably presented in a spinning can is spun to form a yarn and then wound to form a cross-wound bobbin. The individual workstations, in each case, for this purpose have a spinning device and a winding device, both the working members of the spinning device and the working members of the winding device generally being loaded via drive means along the length of the machine. In other words, arranged in the region of the spinning devices, are tangential belts to drive the spinning rotors and the fiber band opening rollers as well as a drive shaft along the length of the machine for loading the fiber band draw-in cylinder. The drive of the bobbin drive roller arranged in the region of the winding devices is also implemented via a drive shaft along the length of the machine. A yarn guide rod going back and forth is also present, which is loaded by a traversing gearing arranged at the end of the machine, and on which the yarn guides are fixed.

Furthermore, yarn take-off mechanisms are present, the driven take-off rollers of which are a component of a continuous drive shaft.

The workstations of such open end rotor spinning machines are attended to by service units, which patrol and automatically intervene, for example, along the workstations when a failure, for example, a yarn break, has occurred at one of the workstations. In such a case, the service unit runs to the relevant workstation, is locked thereat and with a pivotably mounted suction nozzle, which can be vacuum-loaded, seeks the yarn which has run onto the cross-wound bobbin after a yarn break. Apart from the suction nozzle, such service units also have a series of further yarn handling elements, which allow the yarn taken up by the suction nozzle, after a corresponding preparation in the open end rotor spinning device of the relevant workstation, to be repieced on a fiber ring circulating there with the spinning rotor. The individual yarn handling elements of the service unit, including the suction nozzle, are preferably driven by an electric motor which drives a cam disc pack which is connected via special lever rods to the yarn handling elements.

Service units of this type, which are described in relative detail, for example in German Patent Publication DE 198 27 605 A1, are relatively complicated, however, with respect to their design structure and therefore relatively cost-intensive.

Rotor spinning machines, which were still driven without such moveable service units, are also known from the past from German Patent Publications DE-OS 22 03 198 or DE-OS 25 34 816.

In the region of the yarn take-off tubes of their spinning devices, these open end rotor spinning machines, in each case, have a piecing aid, which makes it possible to shorten a yarn retrieved from a cross-wound bobbin to a specific length, to prepare it, convey it back to the rotor groove of a spinning rotor rotating in a spinning housing which can be loaded with a vacuum and to piece it there on a circulating fiber ring.

However, it is disadvantageous in these mechanisms that piecing a new yarn on the fiber ring circulating in the rotor groove takes place in a substantially uncontrolled manner. In other words, in these known mechanisms, there is neither an exact matching of the yarn feed into the spinning rotor nor an exact time matching of the yarn take-off to the speed of the spinning rotor and this leads to the fact that the yarn splices or piecings generated with these known mechanisms do not at all correspond to current quality standards.

Furthermore, open end rotor spinning devices are known which have various single drives in the region of their workstations.

Open end rotor spinning devices are described, for example in German Patent Publication DE 43 09 947 A1, in which the fiber band draw-in cylinder and/or the fiber band opening roller are driven, in each case, via a single drive.

An open end spinning machine is also known from German Patent Publication DE 100 62 096 A1, in which various single drives are arranged, in each case, in the region of the workstations. The workstations of this rotor spinning machine, for example, have an open end rotor spinning device with a single motor-driven fiber band draw-in cylinder, a single motor-driven yarn take-off mechanism and a single drive for the bobbin drive roller.

Furthermore, an open end rotor spinning machine, the workstations of which are configured such that they can automatically eliminate failures, in particular yarn breaks, is described in European Patent Publication EP 1 283 288 A2. The very substantially self-sufficient workstations of this known open end rotor spinning machine, apart from the spinning station's own suction nozzle, also inter alia have single drives for the bobbin drive roller and the yam take-off mechanism. The workstations also, in each case, have a piecing aid device which is arranged in the region of the open end rotor spinning device and in which the yarn provided by the suction nozzle is prepared for re-piecing.

SUMMARY OF THE INVENTION

Proceeding from the above prior art, the invention is based on the object of providing an economical open end rotor spinning machine, which is configured such that the workstations can be restarted without problems after a failure, without a special service unit being necessary for such purpose, wherein the quality of the piecer being produced should correspond to current high quality standards.

This object is achieved according to the invention by an open end rotor spinning machine having plural workstations each having a spinning device for producing a yarn, a yarn take-off mechanism and a winding device for producing a cross-wound bobbin rotatably held in a creel. The spinning device has a spinning rotor circulating in a spinning housing at a high speed, a fiber band opening roller and a fiber band draw-in cylinder driven by a single drive. The yarn take-off mechanism is loadable by a single drive. According to the present invention, each workstation has a mechanism for the defined cutting to length of a yarn retrieved manually from the cross-wound bobbin, a storage mechanism for receiving a specific yarn quantity, and a drive mechanism which can be activated in a targeted manner for lifting the cross-wound bobbin from the bobbin drive roller. The drive of the yarn take-off mechanism is reversibly driven. A manually activatable control mechanism is operable, during a piecing process, to activate the drive of the yarn take-off mechanism, the drive of the fiber band draw-in cylinder and the drive mechanism to lift the cross-wound bobbin according to a predetermined piecing program.

Advantageous further configurations and features according to preferred embodiments of the invention are discussed hereinbelow.

The embodiment of an open end rotor spinning machine as above-described has the advantage, in particular, that it is economical to implement, on the one hand, and, on the other hand, allows splices to be produced, which correspond to current high quality standards. In other words, splices produced after a failure, for example a yarn break, are comparable with splices such as are produced by automatically operating service units with regard to their appearance and their strength. The number of unrecognized "out-of-standard" splices can also be significantly reduced with the mechanism according to the invention, as such splices, when the yarn is taken off from the spinning device, already lead to a yarn break, in particular owing to the high rotor speed. In other words, on average, the quality of the splices produced with the mechanism according to the invention is better than splices which are produced with a service unit. Overall, open end rotor spinning machines with the features described in claim 1 are distinguished by a very favourable price/performance ratio.

In an advantageous embodiment, a stationary mechanism is arranged in the region of the open end rotor spinning device and allows a yarn manually retrieved from the cross-wound bobbin to be cut to length precisely in a simple manner. The yarn that has been cut to length can then immediately be properly prepared for refeeding into the open end rotor spinning device by a manual yarn preparation apparatus which the operator preferably carries on him. In other words, the yarn end is made as far as possible twist-free. The manual yarn preparation has the advantage that the operator can visually check the result of his preparation and optionally correct it. In this manner, it can be ensured that only properly prepared yarn ends are conveyed back into the spinning device for repiecing and this has a very positive affect on the quality of the splices.

It is advantageous that the control mechanism of the workstation is configured and connected to the yarn take-off mechanism in such a way that, on manual activation of the control mechanism, feeding of fibers into the spinning rotor is immediately started and in addition the return of the yarn end that has been cut to length in to the spinning rotor rotating at operating speed is initiated in a manner so as to be precise in terms of time and length. The control mechanism in this case ensures an extremely precise yarn return feed, in other words, the prepared yarn is conveyed back in to the spinning rotor according to instructions and placed on the fiber ring rotating there.

The spinning rotor is either rotated by a tangential belt along the length of the machine or by a single drive. The fiber band opening roller can either be driven by a tangential belt along the length of the machine or by a single drive, which is preferably configured as a so-called external rotor drive.

An embodiment with a tangential belt drive is an economical and proven type of drive, in each case, while a variant with a single drive offers the advantage that a drive of this type can be adapted individually at any time to the respective work situation if necessary.

It is also provided in an advantageous embodiment that a drive mechanism to lift the cross-wound bobbin from the bobbin drive roller is provided in the region of the creel. The drive mechanism is preferably configured here as a sliding piston gearing, which loads the creel, in which the cross-wound bobbin is held and which can be activated in a defined manner via an electromagnetic valve by the control mechanism.

Thus, the cross-wound bobbin can be placed in a targeted manner on the rotating bobbin drive roller during the piecing process and after the repiecing of the yarn can rapidly be accelerated at least to a speed in which the peripheral speed of the cross-wound bobbin corresponds to the yarn take-off speed.

As the acceleration of the cross-wound bobbin, in particular in the case of large bobbins, initially remains slightly behind the yarn take-off, the excess yarn thus occurring is initially compensated by means of a storage mechanism, which operates at this time as a passing yarn store. In other words, a yarn loop is initially formed in a pneumatically loaded yarn store and is slowly released again in the course of the spinning process.

The pneumatic yarn store thus also takes up the yarn length, which is required at the beginning of the piecing process in conjunction with the yarn refeeding.

The creel also has a braking mechanism via which the cross-wound bobbin can be fixed to prevent rotation if necessary. Thus, after the yarn has been manually retrieved, the braking device prevents further yarn material impairing the piecing process from being unwound inadvertantly from the cross-wound bobbin, in addition to the yarn length required in conjunction with the forming of the yarn length for the piecing process.

Further details of the invention can be inferred with the aid of the embodiment described hereinafter in the drawings.

DESCRIPTION OF THE PREFERRED EMBODIMENT

Figure 1:
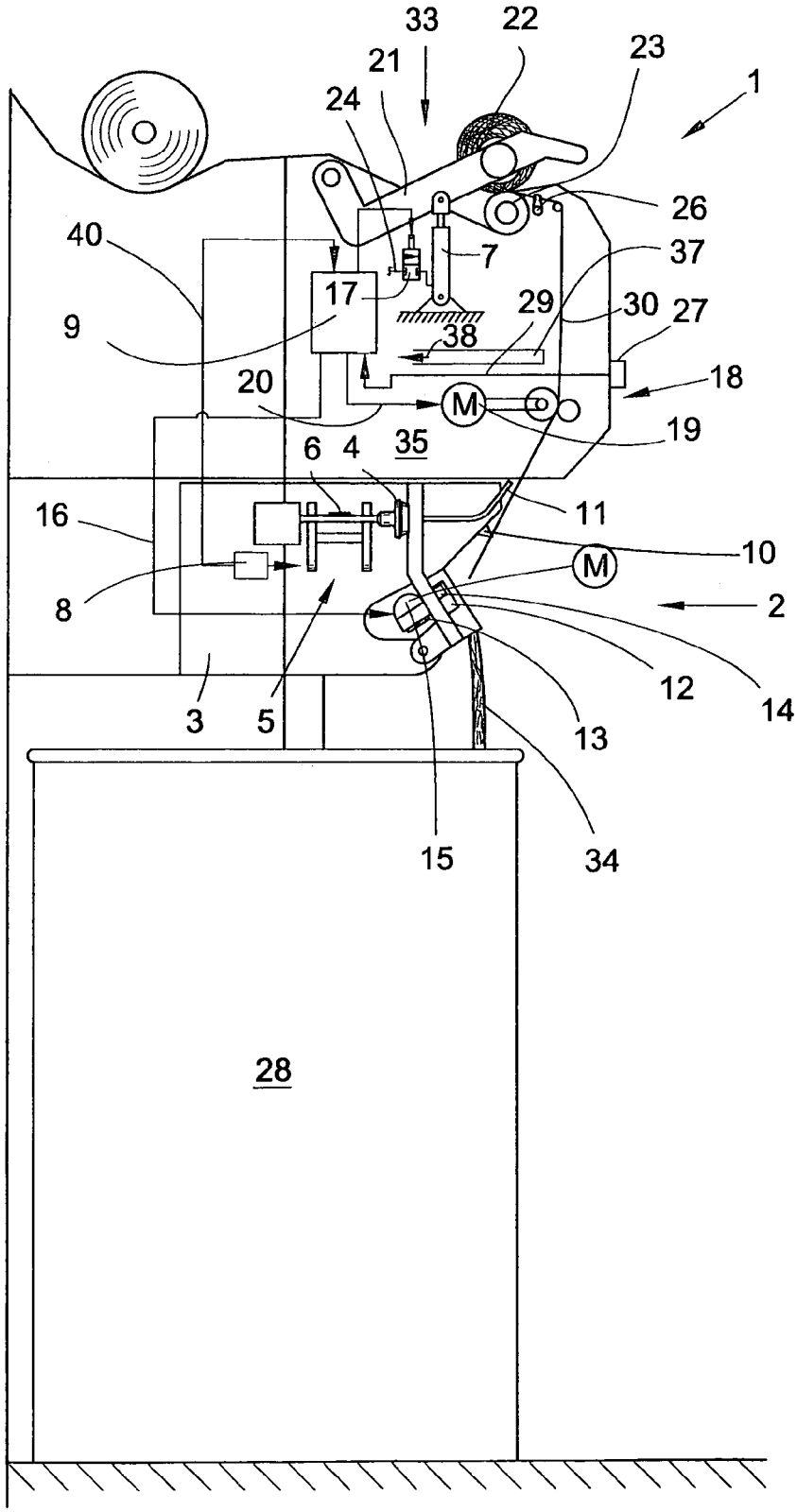
FIG. 1 shows a side view of a first embodiment of a workstation of an open end rotor spinning machine according to the invention, FIG. 2 schematically shows the activation of the single drives of a workstation in a further embodiment of the invention.

FIG. 1 shows one half of a semi-automatic open end rotor spinning machine 1 according to the invention. Spinning machines of this type have a plurality of workstations 2, which are equipped, in each case, with a spinning device 3 and a winding mechanism 33. In the spinning devices 3, the fiber band 34 presented in spinning cans 28 is spun, in each case, to form a yarn 30, which is wound on the winding mechanism 33 to form a cross-wound bobbin 22. The winding mechanisms 33 have, as known per se, a creel 21, in each case, for rotatably holding the tube of a cross-wound bobbin 22, a bobbin drive roller 23, a yarn traversing mechanism 26 and a mechanism 7 for lifting the cross-wound bobbin 22 from the bobbin drive roller 23.

The mechanism 7 is configured for example as a sliding piston gearing, which is connected to an excess pressure source (not shown) via a pneumatic line 24, into which an electromagnetic valve 17 is inserted.

Furthermore, a braking mechanism (not shown), by means of which free rotation of the cross-wound bobbin 22 lifted from the bobbin drive roller 23 can be prevented, if necessary, is arranged on the creel 21.

In the present embodiment, the bobbin drive roller 23 is driven as a group drive. In other words, a drive shaft along the length of the machine is provided, on which the individual bobbin drive rollers 23 are fixed. In an alternative embodiment, however, a single motor drive of the bobbin drive roller 23 is also possible. In a case such as this, the drive of the bobbin drive roller is connected via a corresponding control line to the spinning station's own control mechanism 9.

A yarn lifting mechanism (not shown), known per se, can also be installed in the region of the winding mechanism 33. A yarn lifting mechanism of this type prevents the yarn being able to be grasped inadvertently by the traversing yarn traversing mechanism 26 during the piecing process. In other words, the yarn lifting mechanism configured as a foldable plate, for example, initially holds the yarn during the actual piecing process at a spacing above the yarn traversing mechanism 26 going back and forth.

The spinning device 3 substantially has, as known, a spinning rotor 4, a fiber band opening roller 12 and a yarn band draw-in cylinder 14.

According to the embodiment of FIG. 1, the spinning rotor 4 is mounted in a support disc bearing 5, for example, and is driven via a tangential belt 6 along the length of the machine.

To detect the speed of the spinning rotor 4, a sensor mechanism 8 may also be provided, which is then connected to the control device 9 via a signal line 40. The fiber band opening roller 12 is preferably also loaded via a tangential belt 13 along the length of the machine, while the fiber band draw-in cylinder 14 is driven by a single motor via a drive 15. The drive of the fiber band draw-in cylinder 14, for example a stepping motor 15 is also connected to the control mechanism 9 via a control line 16.

Furthermore, the workstations 2 each have a yarn take-off mechanism 18, the drive 19 of which is connected via a control line 20 to the control mechanism 9.

Viewed in the yarn running direction, a yarn storage mechanism 37, preferably a pneumatically loadable storage nozzle, is provided downstream from the yarn take-off mechanism 18. The storage nozzle 37 is connected, in this case, via a pneumatic line 38 to a vacuum source (not shown).

Figure 3:
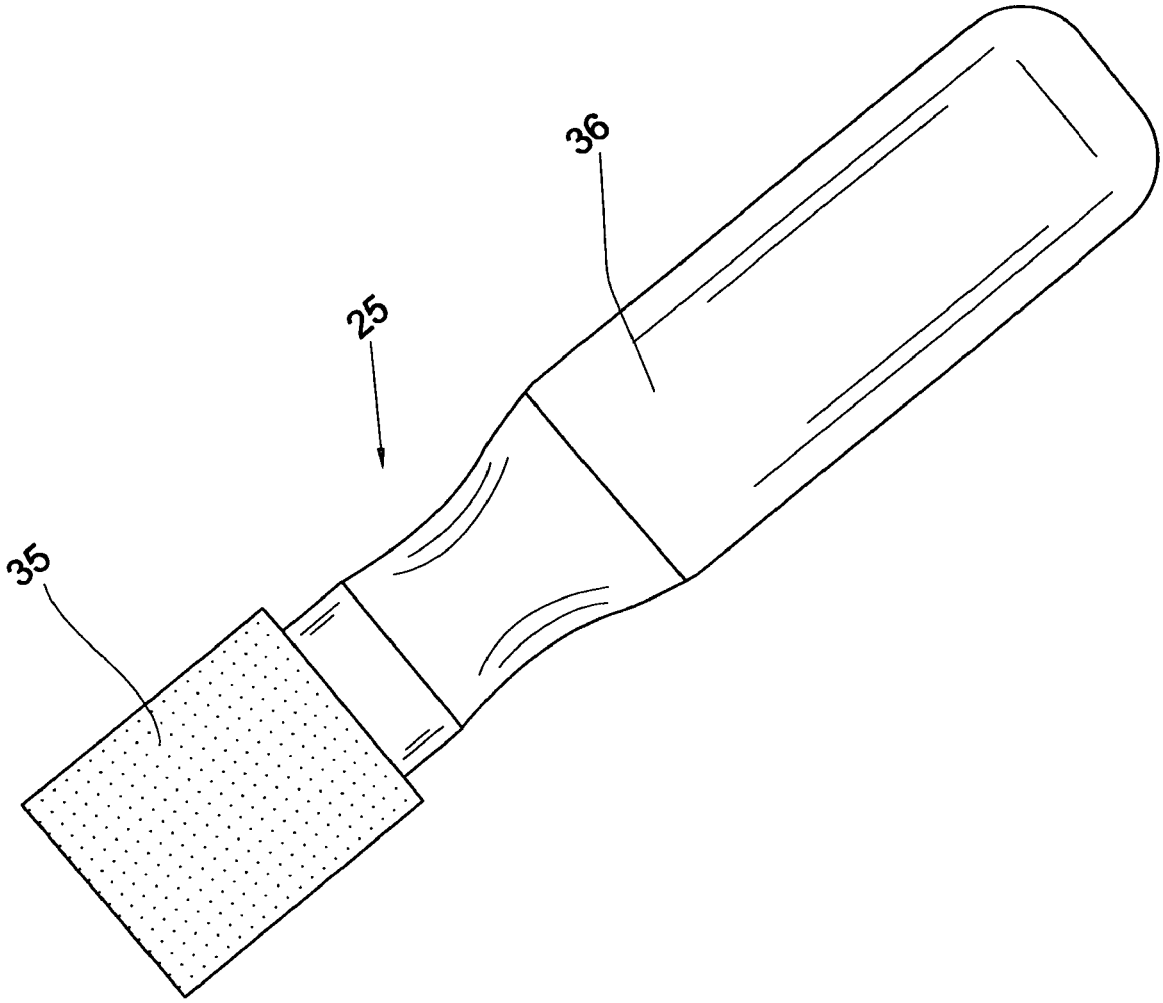
FIG. 3 shows a manual yarn preparation apparatus for treating the yarn end of the yarn that has been cut to length and retrieved by the operators from the cross-wound bobbin.

Finally, a stationary device 10 is arranged in the region of the spinning device 3 and allows defined cutting to length of a yarn retrieved manually from the cross-wound bobbin 22, the yarn end of which can then be treated by the operators by the yarn preparation mechanism 25 shown in FIG. 3.

This yarn preparation mechanism 25 for manually preparing the yarn substantially consists of a handle 36 and a yarn handling region 35 for processing the yarn end.

As indicated in FIG. 1, the control mechanism 9 which controls the drive of the mechanism 7 for lifting the cross-wound bobbin, the drive 16 of the yarn take-off mechanism 18 and the drive 15 of the fiber band draw-in cylinder 14, is connected via a signal line 29 to a switching element 27. In other words, the control mechanism 9 can be activated manually via the switching element 27.

Figure 2:
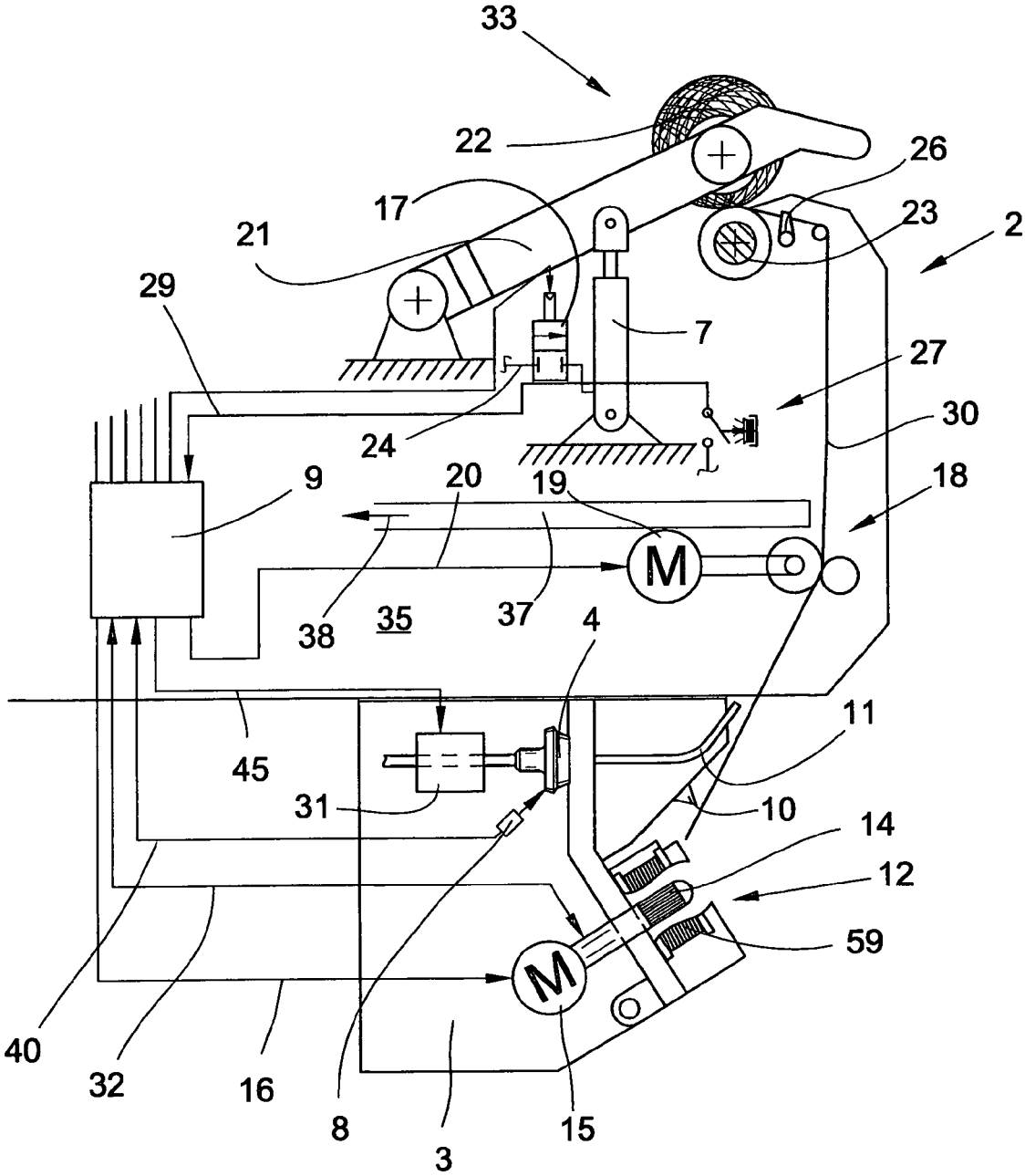

In an alternative embodiment, which is shown in FIG. 2, the spinning rotor 4 is not supported in a support disc bearing 5, but in a magnetic bearing, indicated only schematically. The spinning rotor 4, in a case such as this, is preferably loaded by a single drive 31.

The spinning rotor drive 31 is connected, in this case, via a control line 45 to the control mechanism 9. As also shown in the embodiment according to FIG. 2, the fiber band opening roller 12 can also be driven by a single motor. In other words, arranged inside the clothing ring of the opening roller, is an external rotor drive 59, for example, which is also connected to the control mechanism 9 via a control line 32.

Operation of the open end rotor spinning machine according to the invention occurs as follows:

During the regular spinning process, the yarn 30 produced in the spinning device 3 is taken off by the yarn take-off mechanism 18 and wound on the winding device 33 to form a cross-wound bobbin 22. The cross-wound bobbin 22, which is rotatably mounted between the arms of a creel 21, rests, in this case, with its surface on the bobbin drive roller 23 and is driven by it in the winding direction via frictional engagement. At the same time, the yarn 30 running onto the bobbin is transferred by means of the yarn traversing mechanism 26 in such a way that it runs in crossing layers on to the lateral surface of the cross-wound bobbin 22.

If there is a failure, for example a yarn break, at one of the workstations 2 of the open end rotor spinning machine 1, which may preferably be detected by a stop motion (not shown), the control mechanism 9 ensures that the relevant workstation 2 is stopped.

In other words, the drive 15 of the fiber band draw-in cylinder 14 is firstly switched off in the region of the spinning device 3 and further fiber supply to the spinning rotor 4 is stopped. Simultaneously, the drive 19 of the yarn take-off mechanism 18 is simultaneously switched off and the cross-wound bobbin 22 is lifted from the bobbin drive roller 23 by the mechanism 7. The spinning rotor 4 driven by a tangential belt 6 or the opening roller 12 driven by a tangential belt 13 firstly continue to rotate at operating speed.

When, as shown in the embodiment according to FIG. 2, single drives 31 or 59 are provided for the spinning rotor 4 or the fiber band opening roller 12, in the event of a yarn break, these drives are generally immediately switched off. After a yarn break there are different procedures for repiecing the yarn.

For example there is the possibility of repiecing without clearing the spinning rotor. However, the generally practised method is more probable, in which the spinning device 3 is firstly cleared before repiecing.

If repiecing is to take place immediately without prior cleaning of the spinning rotor, the cross-wound bobbin 22 lifted from the bobbin drive roller 23 is initially rotated manually in the unwinding direction, the yarn 30 which has run on to the lateral surface of the cross-wound bobbin 22 after the yarn break is picked up by the operator and returned to the region of the spinning device 3. The cross-wound bobbin 22 is then fixed by the braking mechanism to prevent rotation and the tightly drawn yarn 30 is placed by the operator in the yarn take-off mechanism 18. By actuating the control mechanism 9, the operator then ensures that the yarn take-off mechanism 18 briefly starts to run counter to the yarn take-off direction, with a precisely predetermined yarn quantity being sucked into the pneumatic yarn store 37 of the workstation 2 and stored there.

In the case of a generally practised, prophylactic or necessary clearing of the spinning rotor, the spinning device 3 has to be initially opened by the operator. If the spinning device 3 has a spinning rotor 4 driven by a tangential belt 6 and a fiber band opening roller 12 driven by a tangential belt 13, (embodiment FIG. 1), these are automatically separated from their drive means on opening the spinning device 3 and run down to a standstill. The spinning rotor 4 is preferably additionally braked by a rotor brake. These rotatable components are also initially braked to a standstill in the embodiment according to FIG. 2, in which the spinning rotor 4 and the opening roller 12 are loaded by single drives.

After clearing, the spinning device 3 is closed again and, for example, the spinning rotor 4 and the opening roller 12 placed on their associated tangential belts 6 or 13.

The spinning rotor 4 and the opening roller 12 then run up to their operating speed. At the same time, as explained above, the yarn 30 is retrieved manually from the cross-wound bobbin 22, the tightly drawn yarn 30 is placed in the yarn take-off mechanism 18, the yarn take-off mechanism 18 is briefly driven counter to the yarn take-off direction and a yarn loop is formed in this case in the pneumatic yarn store 37.

In the two cases, the yarn 30 is then cut to length at the stationary device 10 which is arranged in the region of the spinning device 3 and the yarn end is manually prepared for repiecing by means of a preparation mechanism 25 which in each case is in the possession of the operator. The prepared yarn end is finally yarned into the yarn take-off tube 11 of the spinning device and the control mechanism 9 is activated via the switching element 27.

The control mechanism 9 then initiates the drive 15 of the fiber band draw-in cylinder 14, so, in conjunction with the fiber band opening roller 12, which is rotating at operating speed, in the spinning rotor 4, a fiber ring is produced.

With a small, defined time delay, the control mechanism 9 also activates the drive 19 of the yarn take-off mechanism 18 in such a way that a targeted yarn return of the prepared yarn end of the yarn 30 into the spinning device 3 takes place. In other words, the yarn end, in the spinning device 3, is placed on the fiber ring circulating with the spinning rotor 4 in manner so as to be precise in terms of time and length, the fiber ring is broken open and the yarn 30 being newly produced is taken off from the spinning device 3 via the yarn take-off mechanism 18, which was switched over to forward speed at a precise time by the control mechanism 9. At the same time, the cross-wound bobbin 22 is lowered via the mechanism 7 onto the rotating bobbin drive roller 23 and the yarn 30 is wound on the winding device 33 to form a cross-wound bobbin 22. The speeds with which the fiber band draw-in cylinder 14 and the yarn take-off mechanism 18 operate are thus matched precisely to the speeds of the spinning rotor 4, fiber band opening roller 12 and bobbin drive roller 23 very substantially predetermined by the group drives.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open end rotor spinning machine with plural workstations (2) each having a spinning device for producing a yarn, a yarn take-off mechanism (18) and a winding device for producing a cross-wound bobbin (22) rotatably held in a creel having a bobbin drive roller (23), each spinning device having a spinning rotor circulating in a spinning housing at a high speed, a fiber band opening roller and a fiber band draw-in cylinder (14) driven by a single drive (15), each yarn take-off mechanism (18) being loadable by a single drive (19) and each drive 19 of each yarn take-off mechanism 18 being reversibly driven, each workstation (2) having located thereat and dedicated exclusively to the respective workstation and separate from other workstations:

(i)a mechanism (10) for the defined cutting to length of a yarn (30) retrieved manually from the respective workstation's cross-wound bobbin (22), (ii) a storage mechanism (37) for receiving a specific yarn quantity, (iii) a drive mechanism (7) which can be activated in a targeted manner for lifting the respective workstation's cross-wound bobbin (22) from the bobbin drive roller (23), and (iv) a manually activatable control mechanism (9) operable, during a piecing process, to activate the respective workstation's drive (19) of the yarn take-off mechanism (18), the respective workstation's drive (15) of the fiber band draw-in cylinder (14) and the respective workstation's drive mechanism (7) to lift the cross-wound bobbin (22) according to a predetermined piecing program.

2. An open end rotor spinning machine according to claim 1, characterized in that the mechanism (10) for defined cutting to length of the retrieved yarn (30) is stationarily arranged in the region of the open end spinning device (3) and in that a yarn preparation apparatus (25) is provided for manual preparation of the yarn end.

3. An open end rotor spinning machine according to claim 1, characterized in that the control mechanism (9) is configured and connected to the drives (19 or 15) of the yarn take-off mechanism (18) or of the fiber band draw-in cylinder (14) such that, on activation of the control mechanism (9), fibers are properly fed into the spinning rotor (4) rotating at the operating speed, the yarn end which has been cut to length is conveyed back into the spinning rotor (4) in a manner which is accurate in terms of time and length, and a take-off of the produced yarn (30) from the spinning device (3) is started.

4. An open end rotor spinning machine according to claim 1, characterized in that the spinning rotor (4) is driven by means of a tangential belt (6) along the length of the machine.

5. An open end rotor spinning machine according to claim 1, characterized in that the spinning rotor (4) is driven by means of a single drive (31).

6. An open end rotor spinning machine according to claim 1, characterized in that the fiber band opening roller (12) is driven by means of a tangential belt (13) along the length of the machine.

7. An open end rotor spinning machine according to claim 1, characterized in that the drive of the fiber band opening roller (12) takes place via a single drive (59) which is preferably configured as an external rotor.

8. An open end rotor spinning machine according to claim 1, characterized in that the drive mechanism (7) to lift the cross-wound bobbin (22) is configured as a sliding piston gearing (7), which loads the creel (21) and can be activated in a defined manner via an electromagnetic valve (17).

9. An open end rotor spinning machine according to claim 1, characterized in that the storage mechanism is configured as a pneumatically loadable yarn store (37).

* * * * *